United States Patent [19]

Larrabee

[11] 4,387,483

[45] Jun. 14, 1983

[54] EXTRACTING HANDLE FOR EARTH DRILL AUGERS

[76] Inventor: Edward M. Larrabee, 86 Snowden La., Princeton, N.J. 08540

[21] Appl. No.: 167,749

[22] Filed: Jul. 11, 1980

[51] Int. Cl.[3] ..... A47B 95/02

[52] U.S. Cl. ..... 16/114 R; 173/163; 175/170

[58] Field of Search ..... 173/163; 74/545, 543, 74/548; 16/111 R, 114 R; 175/170

[56] References Cited

U.S. PATENT DOCUMENTS

| | | | |
|---|---|---|---|
| 345,698 | 7/1886 | Jones . | |
| 513,320 | 1/1894 | Hardsocg . | |
| 577,411 | 2/1897 | Barnes | 173/163 X |
| 615,794 | 12/1898 | Bradley et al. . | |
| 857,751 | 6/1907 | Parker . | |
| 1,042,873 | 10/1912 | Betts . | |
| 1,193,725 | 8/1916 | Smith . | |
| 1,202,551 | 10/1916 | MacKenzie . | |
| 1,213,989 | 1/1917 | Wilson . | |
| 1,305,792 | 6/1919 | Fraser . | |
| 1,343,384 | 6/1920 | Blackburn . | |
| 1,455,163 | 5/1923 | Blackburn . | |
| 1,612,713 | 12/1926 | Fienberg | 74/545 UX |
| 1,787,185 | 12/1930 | Baird | 16/114 R |
| 1,791,185 | 2/1931 | Birkenmaier . | |
| 1,795,327 | 3/1931 | Birkenmaier et al. . | |
| 1,878,569 | 9/1932 | Zolleis | 74/548 |
| 1,935,065 | 11/1933 | Stevens . | |
| 2,061,218 | 11/1936 | Watson . | |
| 2,320,612 | 6/1943 | Kandle | 175/170 |
| 3,896,890 | 7/1975 | Gale . | |
| 4,116,284 | 9/1978 | Cox . | |

OTHER PUBLICATIONS

Manufacture's brochure entitled "Mechanical Earth Drills–Little Beaver", dated Apr. 17, 1980.

*Primary Examiner*—Andrew V. Kundrat
*Attorney, Agent, or Firm*—Richard C. Woodbridge

[57] ABSTRACT

An extricator handle includes a quick snap-on feature for easy attachment to jammed earth augers. The invention preferably comprises a pair of hand grip bars, a receptacle box, an adaptor element and a locking bolt. The shaft of the jammed earth auger is received in a cavity in the adaptor element. The earth auger includes a spring-loaded pushbutton which locks into a complementary aperture in the sidewall of the adaptor element. The adaptor element is received in a cavity in the receptacle box. A threaded aperture in the adaptor receives the locking bolt which passes through another aperture in the receptacle box. The handle may be easily snap fitted onto the exposed shaft of a jammed auger and then manually turned to dislodge the auger from its jammed position.

10 Claims, 14 Drawing Figures

EXTRACTING HANDLE FOR EARTH DRILL AUGERS

BACKGROUND OF THE INVENTION

1. Field of the Invention

The invention relates to an extricating handle used to remove earth drill augers which have become lodged under buried objects in the ground.

2. Description of the Prior Art

The problem of removing lodged probing bars, mining drill bits, earth anchors and similar devices has received the attention of inventors for nearly a century. There are at present on the market portable earth augers which may be used for the purpose of drilling post holes or performing soil and archaeological strata investigations. Typical of such devices is the "Little Beaver" which is referred to in U.S. Pat. No. 4,116,284.

The use of extricating wrenches is disclosed in, among other things, U.S. Pat. No. 1,042,873. Note in particular, page 2, line 69–80 of that disclosure. Other drill extricators are disclosed in U.S. Pat. No. 1,202,551 and 1,213,989.

U.S. Pat. No. 2,061,218 discloses a "Convertible Post Hole Digger" in which the earth auger includes an integral handle.

The following U.S. Patents are of interest in that they disclose the use of removable handles that are adapted to engage the rectangular shank of an auger or earth screw anchor: U.S. Pat. Nos. 345,698; 1,193,725; 1,343,384; 1,455,163; 1,791,185; and 1,795,327.

U.S. Pat. No. 513,320 is of interest in that a single arm crank handle is disclosed and described as fitting on the box-like end of a coal twist drill.

The following U.S. Patents are also of interest in that they disclose removable handles for drill and land anchors and the like adapted to fit on round shafts: U.S. Pat. Nos. 615,794; 857,571; 1,305,792 and 1,935,065.

U.S. Pat. No. 3,896,890 is relevant in that it describes a means for screwing an anchor into the earth through the use of a mandril which is then removed by unscrewing. In this manner, an earth anchor is placed in the earth with a minimum of disturbance to the soil above and around it through the use of power driven equipment.

SUMMARY OF THE INVENTION

Briefly described, the invention comprises an extracting handle which, when affixed to the auger of a mechanical earth drill that has become lodged in the soil, allows for rapid and easy manual removal of the auger. In common use, the auger bits of prior art earth drills often become jammed on rocks, tree roots, and other obstructions. Because the power head transmissions of prior art earth drills rotate clockwise under power and are free turning in a counterclockwise direction, they cannot be used to "unscrew" jammed augers from the holes in which they have become stuck. Therefore in order to dislodge jammed augers it is often necessary to rock them back and forth or jerk and pull on them violently. Violent action tends to bend the auger shaft or damage the flighting. If the auger cannot be extricated by those methods, then it must be dug out by hand, which is difficult, time consuming, expensive and defeats the entire labor-saving purpose of the motorized earth drill.

The present invention can be quickly fastened onto a jammed auger, in place of the power head, and by manually applying torque in a counter-clockwise direction, the handle permits any operator to "unscrew" the jammed auger with ease. According to the preferred embodiment, the extracting handle consists of two arms or hand grips projecting on opposite sides of a head or receptacle which holds an adaptor available from the manufacturer of conventional prior art earth drills. The adaptor snaps onto the shaft of the jammed auger after the power head has been unsnapped. Two or three easy turns in the counter-clockwise direction will reverse the auger so that the flighting moves above the obstruction. The auger can then be lifted out of the hole. In the preferred embodiment, a bolt attaches the adaptor to the head. Alternative embodiments would allow for the head to snap directly onto the shaft of the auger, dispensing with the adaptor, or might affix the hand grips in a variety of different convenient configurations. All of the alternative embodiments retain the essential element of permitting easy manual application of reversing torque in order to unscrew jammed augers. These and other features of the invention will be more fully appreciated with reference to the following brief description of the drawings and detailed description of the invention.

DETAILED DESCRIPTION OF THE INVENTION

During the course of this description like numbers will be used to indicate like elements according to the different views which illustrate the invention.

The present invention is best understood in the context of the following description of the problems associated with prior art earth drills. The preferred embodiment 10 of the present invention specifically applies to a prior art earth drill known as the "Little Beaver Model 5 Earth Drill" available from Little Beaver, Inc., P.O. Box 840, Livingston, Texas 77351. The Little Beaver Model 5 Earth Drill is typically driven through a flexible shaft and stabilized by a torque bar which is the subject of U.S. Pat. No. 4,116,284 issued to Cox on Sept. 26, 1978.

Figure 1A:
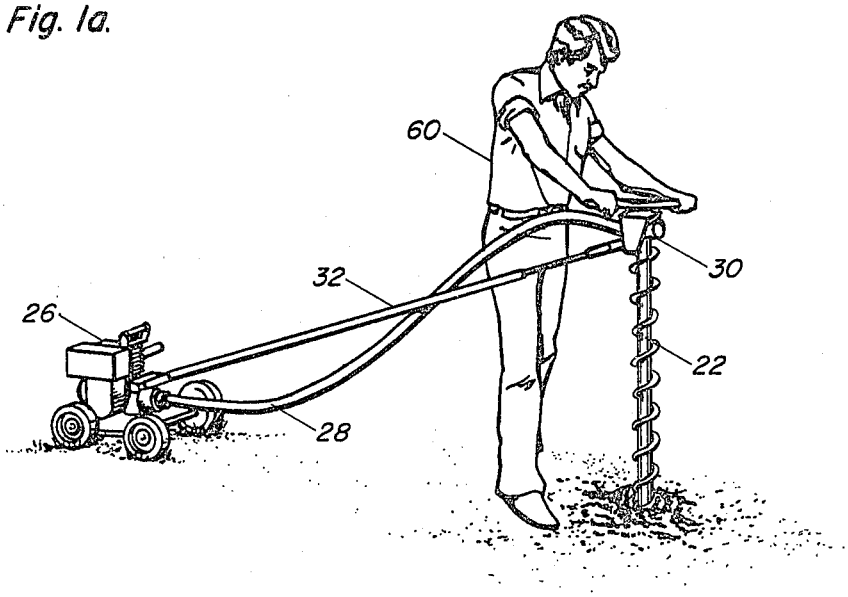
FIG. 1A illustrates an operator starting to drill a hole with a conventional motor driven earth drill.

FIG. 1A illustrates a conventional earth drill as used by an operator 60 in the field to drill a hole. These devices are frequently used as post hole diggers or for archaeological exploration purposes. Briefly described the apparatus consists of a power source 26, typically a small internal combustion engine, mounted on wheels. Power from power source 26 is carried by means of a flexible shaft 28 to a geared transmission in power head 30. Operator 60 holds the power head 30 in position. A rigid telescoping torque bar 32 connects the power source 26 to the power head 30. Torque bar 32 counteracts the effect of uni-directional rotation and cushions the shock that occurs when the earth drill hits a subterranean object. Auger 22 is fastened into the power head 30. A wide variety of augers 22 are available and vary in size and structure from application to application. Power from engine 26 is transmitted through flexible shaft 28 to the power head 30 which in turn causes the auger 22 to rotate in a clockwise direction. Clockwise rotation of auger 22 causes it to screw into the ground creating a hole 34. In the process earth is moved upwards by the auger flighting and is deposited around the periphery of hole 34.

Figure 1B:
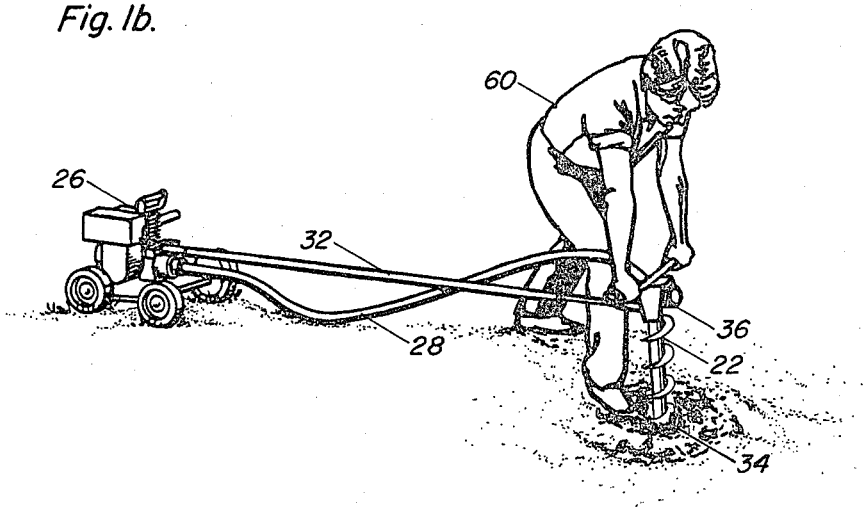
FIG. 1B illustrates the operator straining to remove the earth drill after the auger flighting has become jammed in the hole.

FIG. 1B illustrates the common situation in which the auger 22 has become stuck. Operator 60 is shown straining to pull it out of the hole 34. Unfortunately the stuck auger 22 cannot be unscrewed because it freely turns in the counter-clockwise direction when engaged in power head 30. Rotation of the entire earth drill assembly 26, 28, 30 and 32 will not cause the auger 22 to back out of the hole. Therefore, the operator 60 must try to twist, rock, or shake the power head 30 and auger 22 in order to remove it from hole 34. If that fails, the operator ultimately must dig the drill out by hand or with a shovel, thereby consuming large amounts of time and energy.

Figure 1C:
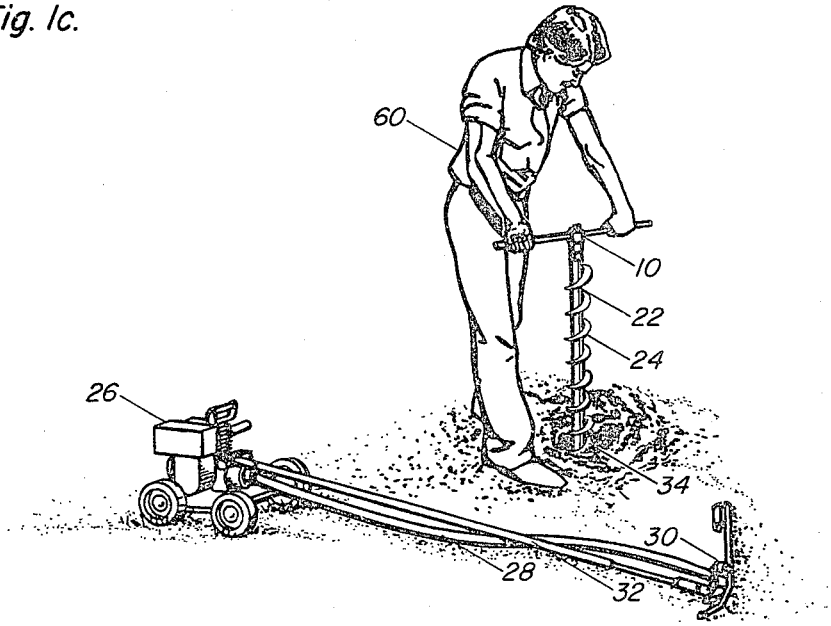
FIG. 1C illustrates the operator unscrewing the auger, using the extricating handle of the preferred embodiment of the present invention.
Figure 3:
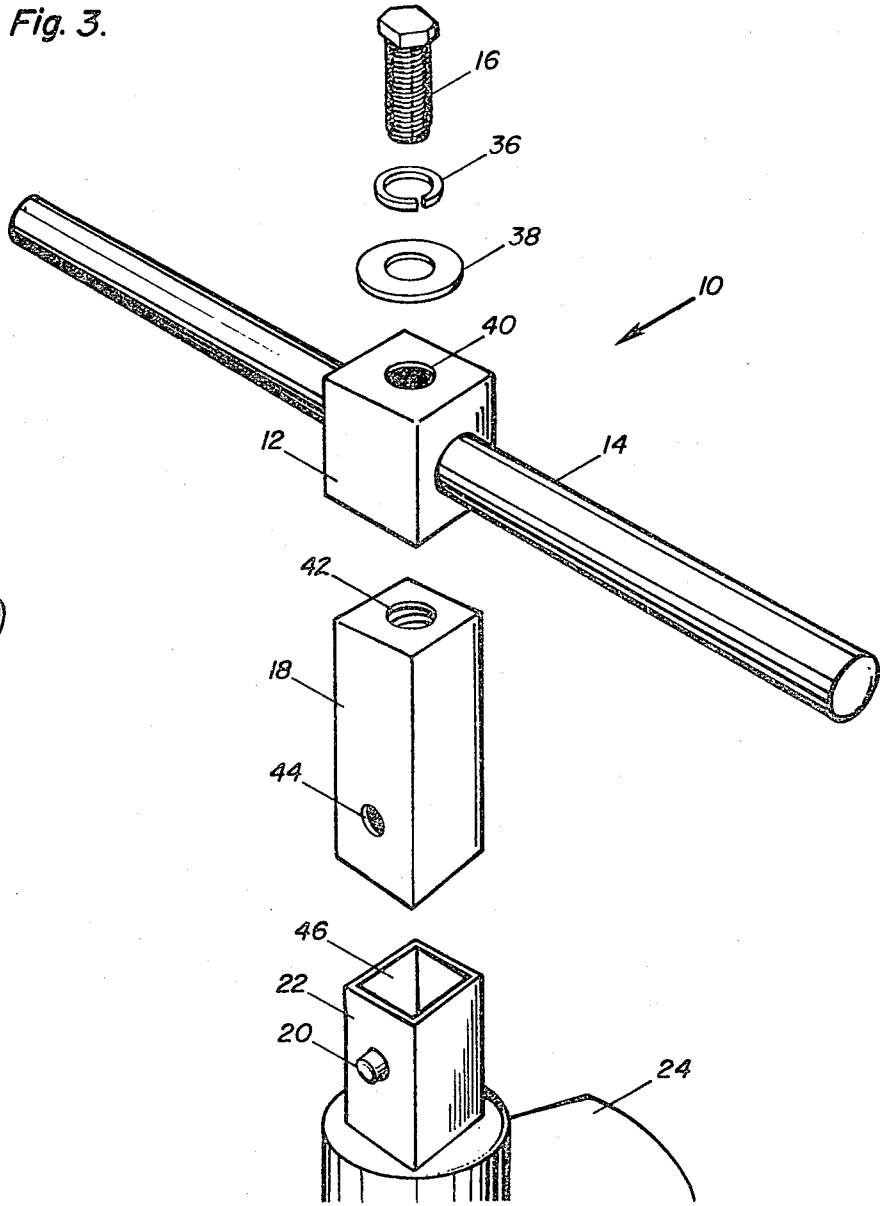
FIG. 3 is an exploded perspective view of the preferred embodiment of the extracting handle.

FIG. 1C illustrates the situation in which an operator 60, equipped with the preferred embodiment of the extricating handle 10, is able to easily unscrew the auger 22 from the hole 34. As shown in FIG. 1C the operator has removed the entire earth drill assembly 26, 28, 30 and 32 prior to snapping the extricating handle 10 onto the top of auger 22. The operator 60 then manually applies torque in a counter-clockwise direction. In so doing the direction of rotation of the screw-like threads or flighting 24 of the auger 22 is reversed and the auger 22 is easily unscrewed from the hole 34 in which it has become stuck. Once the auger 22 is unstuck it is easily lifted out of hole 34 by operator 60 since the weight of the present invention 10 and auger 22 is relatively light, compared to the power head.

Figure 2:
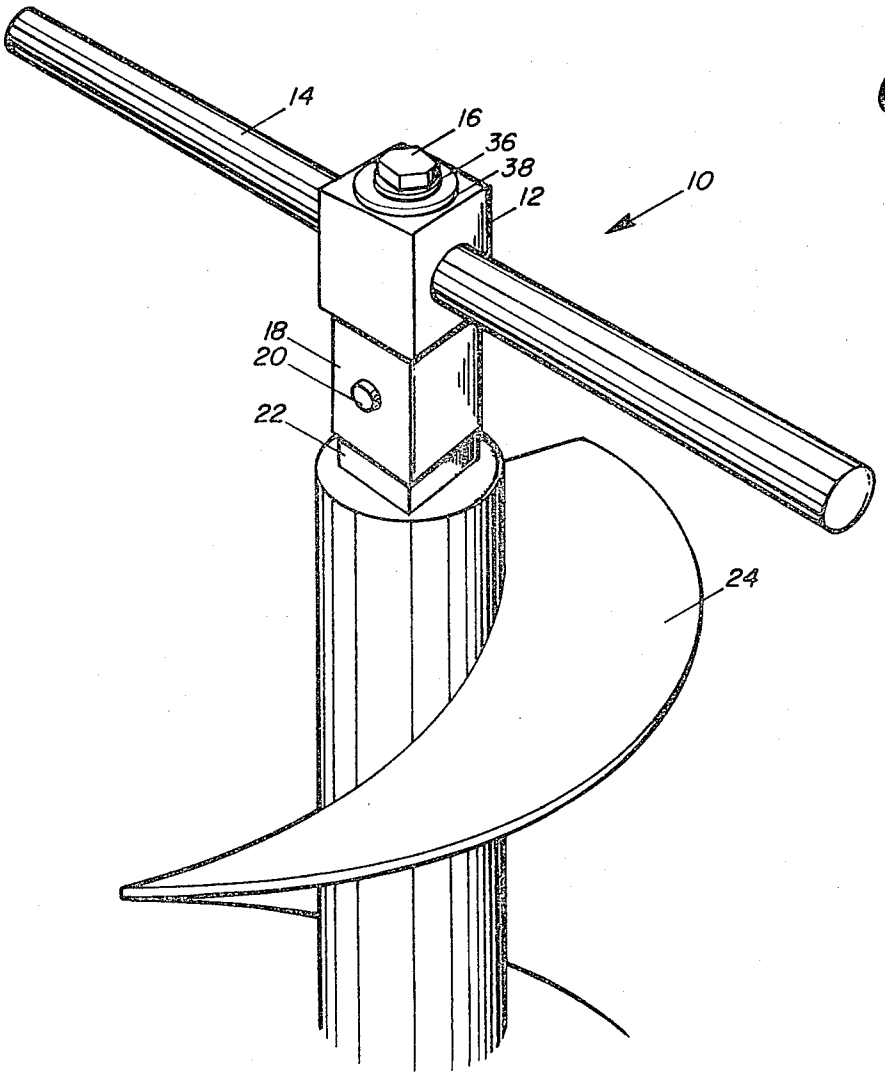
FIG. 2 is a perspective view of the preferred embodiment of the extricating handle as attached to a conventional auger shaft.

The present invention 10 is easily understood by referring to the perspective view of FIG. 2 and views 3–7B which also illustrate the preferred embodiment of the invention. As shown in FIG. 2 the preferred embodiment consists of a box-like head or receptacle 12 to which are attached two opposing hand grips or arms 14, for manual application of reverse torque. A locking bolt 16 passes through head 12 to hold adaptor 18. Adaptors are available from manufacturers and typically include a locking hole 44 into which the spring-loaded button 20 of the auger 22 will snap. A typical auger 22 includes clockwise flighting 24 which surrounds the shaft in a spiral screw-like fashion. Additional detailed features of the invention will be appreciated from exploded view 3. As shown in that view, bolt 16 passes through a lock washer 36 and a flat washer 38 into hole 40 of the receptacle head 12. The bolt 16 is then received in threaded hole 42 of adaptor 18. The threading is formed inside a thick washer-like element 56 fastened to the inside of adaptor 18. Spring-loaded pushbutton 20 is depressable in the direction of cavity 46 which exists inside the shaft of auger 22. With the button 20 depressed it is possible to slip the shaft of auger 22 into the cavity 50 of adaptor 18. Further insertion of the shaft 22 into cavity 50 causes button 20 to snap into locking hole 44 thereby locking the handle 10 and auger 22 together.

Figure 4:
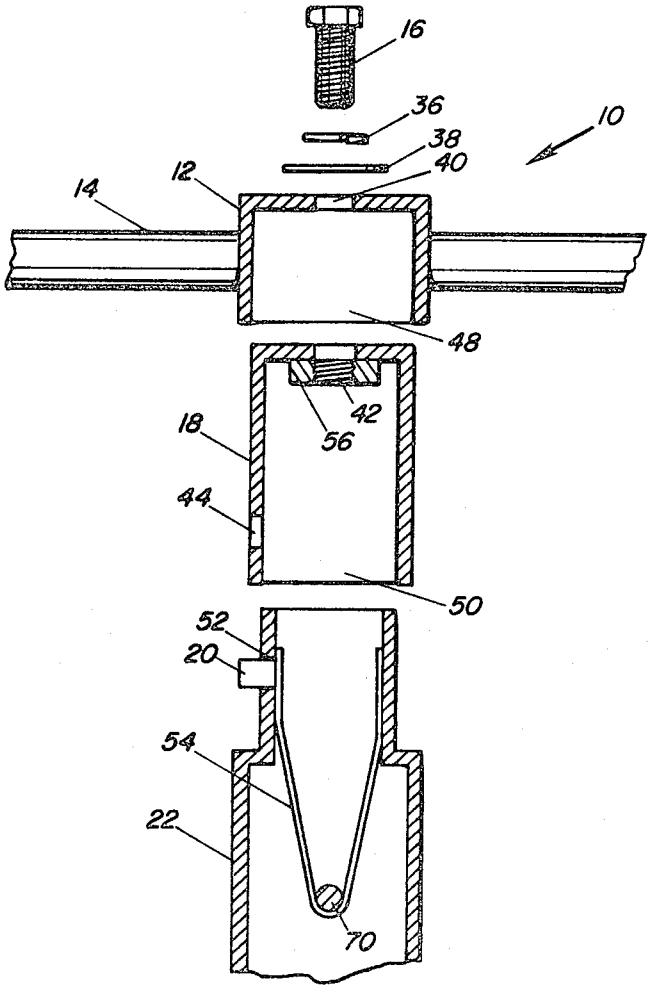
FIG. 4 is an exploded cross-sectional elevational view through the central axis of the preferred embodiment of the extracting handle.

The exploded cross section of FIG. 4 indicates how leaf spring 54 is attached to spring-loaded button 20 on the interior 46 of the hollow shaft of auger 22. Button 20 normally protrudes through hole 52 in the side wall of auger 22. Occasionally the adaptor 18 is surrounded by a pliable plastic sleeve which covers locking hole 44. The sleeve, not shown, is optional and keeps the adaptor from filling up with dirt and field debris. In the preferred embodiment the adaptor 18 fits into the cavity 48 on the inside of head 12. As previously described the adaptor 18 is connected to head 12 by bolt 16.

Figure 5:
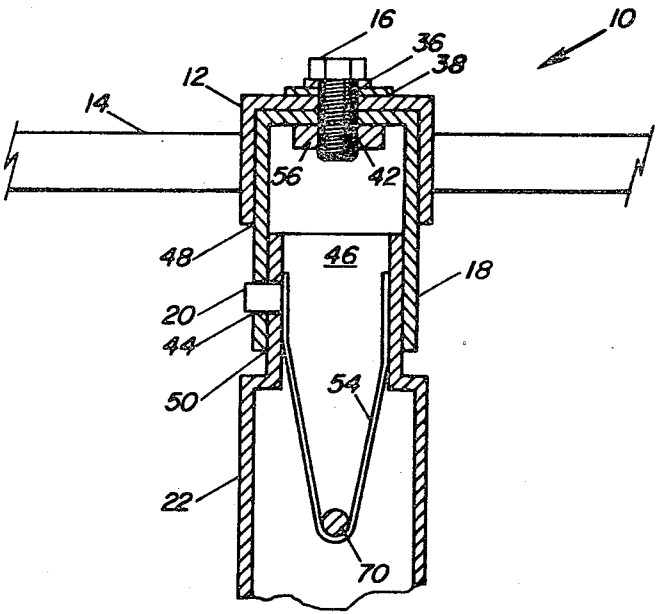
FIG. 5 is a standard vertical cross-sectional elevational view through the central axis, of the preferred embodiment of the extracting handle.

The fully assembled version of the present invention 10 is seen in vertical cross-section in FIG. 5. In that view it is clear that the head 12 snugly receives the adaptor 18 so that manual application of reverse torque results in efficient and rattle-free reverse rotation of auger 22. Also, clearly visible in FIGS. 4 and 5 is a keeper pin 70 located in the interior cavity 46 of the auger shaft for anchoring leaf spring 54 in position. It will also be appreciated that the present invention 10 can be used under certain circumstances to convert the auger 22 into a manual soil auger, either for greater precision and control, or because the prior art power unit 26 is absent or inoperative.

Figure 7A:
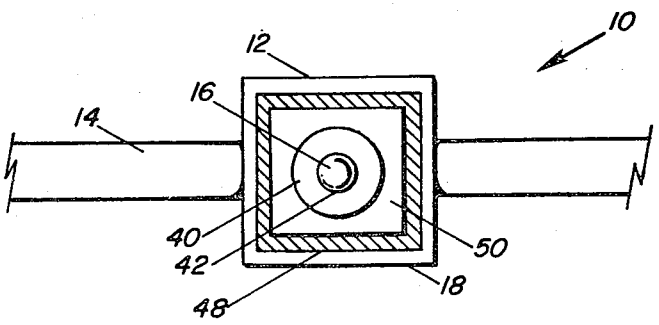
FIG. 7A is a horizontal cross-sectional view of the embodiment illustrated in FIG. 6 looking upward towards bolt 16.
Figure 7B:
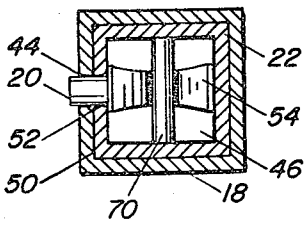
FIG. 7B is a horizontal cross-sectional view of the preferred embodiment illustrated in FIG. 6 looking downward towards the shaft of auger 22.
Figure 6:
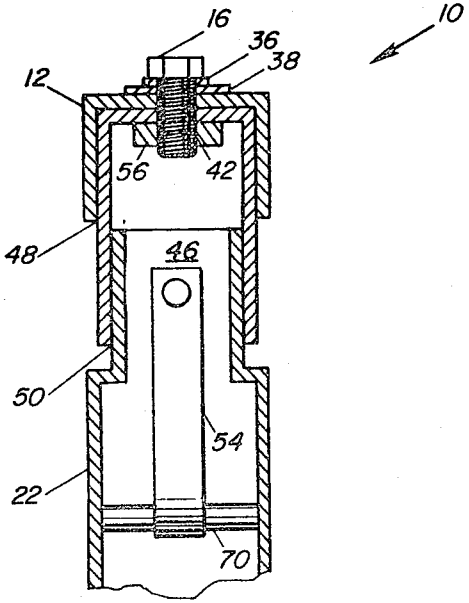
FIG. 6 is a standard cross-sectional elevational view of the extracting handle rotated 90° with respect to the view shown in FIG. 5.

FIG. 6 is a vertical cross-sectional view similar to that of FIG. 5 except taken from a plane rotated 90° with respect to the plane of the cross-section of FIG. 5. Similarly, the horizontal cross sectional views of FIG. 7A and 7B are taken from the same plane but looking in directions 180° reversed from each other. FIG. 7A illustrates the fit of the adaptor 18 into cavity 48 of head 12. FIG. 7B illustrates the fit of auger 22 into cavity 50 of adaptor 18. FIG. 7B also illustrates in detail how the snap button 20 is received in locking hole 44.

FIGS. 8A–8D illustrate several alternative embodiments of the basic invention 10. All of the embodiments retain the essential elements of allowing an extractor handle to be easy placed upon the top portion of an auger shaft 22 for the purpose of easily applying manual reverse torque in order to unscrew a jammed auger 22. The alternative embodiment 58 shown in FIG. 8A includes four arms or hand grips which can screw into head 12. The use of additional hand grips allows other people to help unscrew a lodged auger 22. By making the hand grips unscrewable it is possible to make the extractor handle 58 more compact and portable.

Figure 8C:
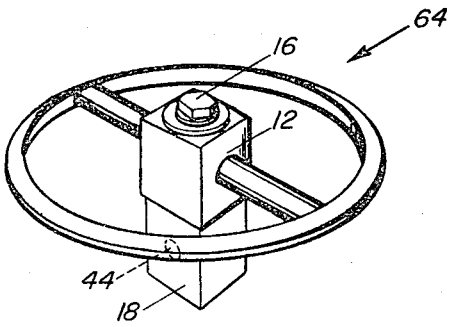
FIG. 8C is another alternative embodiment of the present invention illustrating the use of a wheel attached to the extremeties of the hand grip bars for additional leverage
Figure 8D:
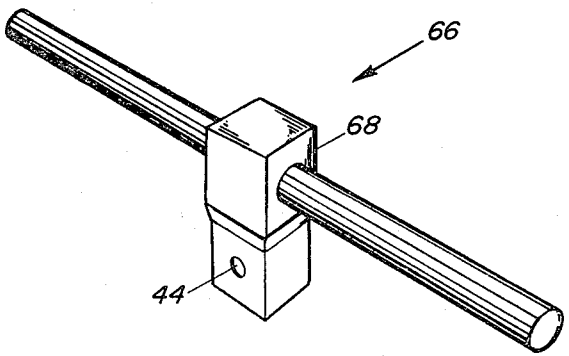
FIG. 8D illustrates an alternative embodiment of the invention in which all of the elements of the extracting handle are integral and continuous.
Figure 8A:
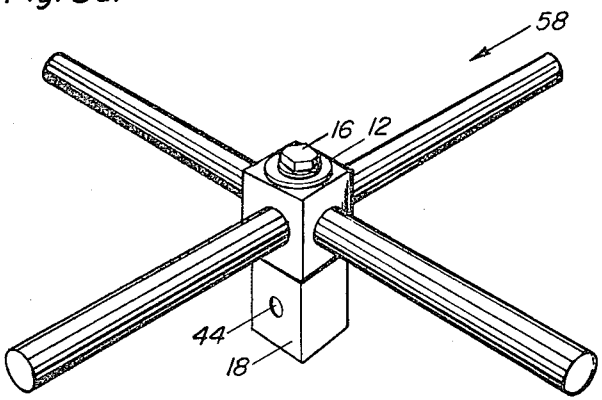
FIG. 8A is an alternative embodiment of the preferred invention showing four hand grip bars screwed into the receptacle box.
Figure 8B:
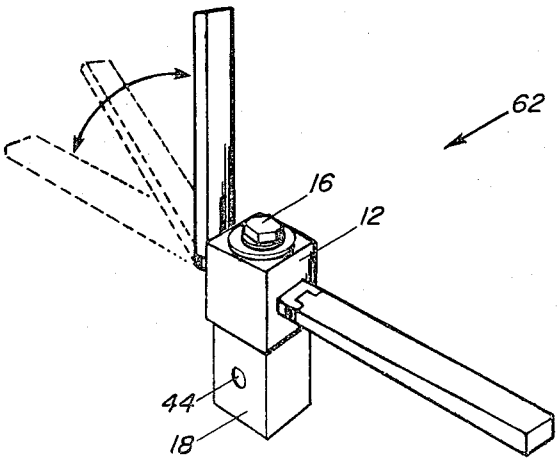
FIG. 8B is another alternative embodiment of the present invention illustrating the hand grip bars attached to the receptacle box by means of hinges.

The alternative embodiment 62 illustrated in FIG. 8B provides for handgrips which are connected to head 12 by hinges. This embodiment allows the handgrips to be rotated out of the way for ease of transport or storage.

The alternative embodiment 64 illustrated in FIG. 8C provides for a continuous, circular wheel grip attached to the ends of the hand grips. This arrangement can be thought of as a wheel having two or more spokes radiating from the head 12. Under certain circumstances it might be easier to deal with a wheel-like grip because the force is applied to the extremes of the hand grips thereby improving the leverage of the operator 60.

The alternative embodiment 66 illustrated in FIG. 8D is one in which the adaptor 18 has been completely integrated into the structure of head 12. Accordingly, the embodiment 66 is entirely continuous and locking hole 44 is built right into the structure itself. While the continuous embodiment 66 of FIG. 8D has some advantages, it may also have some disadvantages. In particular it may only be possible to fit the continuous handle onto one side shaft. According to the preferred embodiment 10, a variety of different adaptors 18 can be received in the head 12 thereby allowing the preferred embodiment to be attached to a greater spectrum of earth augers 22.

There are many advantages of the present invention. The most basic advantage is that it allows an operator 60 to snap an extractor handle 10 on a jammed earth auger 22 and remove it quickly. In some cases the removal operation takes as little as 5 seconds. As far as is now known, there do not appear to be any similar devices on the market suitable for the purpose of quickly and easily removing jammed earth augers of the motor driven variety. As a correlary, the extractor handle 10 can be used, in special situations, as the prime mover for an earth auger. This advantage turns the conventional motor driven earth auger apparatus into a more flexible piece of equipment. In effect, it allows for the conversion of each motor driven auger into a manual soil auger, capable of being used wherever a person can carry it. Thus holes can be drilled even in places where the motor unit cannot be taken (because it is too heavy, too large, etc.) Moreover, it also allows the earth auger to be manually driven if the power source is inoperative.

Prior to the present invention it was only possible to motor drill a hole and observe the soil which piles up beside it. Exact depths at which soil horizons occur or objects were found could not be accurately determined because some of the earth is always lost due to the rotational speed of the auger bit and samples become contaminated because the rotating flighting on the screw auger carries lower material up which scrapes against the sides of higher soils. With the present invention, each auger bit, operated manually, becomes an instrument capable of controlled sample-taking. This is especially important for archaeological examinations. It is now possible to determine the exact depth and provenience of significant finds or of color and texture changes. Therefore, by applying the handle to a conventional motor driven earth auger it is possible to quickly change from "present" or "absent" types of soil samplings to tests which are more substantitive, thereby providing better information with regard to soil science, geology and archaeology. In other words, a motor driven earth auger gives fairly good "gross" data whereas conversion to a manual earth auger gives good "fine" data. The conversion from "gross" to "fine" soil data at the appropriate time greatly improves the efficiency of the overall operation.

Finally, if an extension is added to a conventional motor driven earth auger it is possible to have as much as 6 ft. or more of auger in a bored hole. Such an arrangement is very heavy because the loose dirt resting on the flighting of the auger causes the whole apparatus to be rather cumbersome. Without the present invention it is therefore necessary to remove the very long, heavy auger and extension combination, frequently loaded with dirt, by lifting the equally heavy power head to a height of 6 ft. or more above the ground. Alternatively, an operator 60 had to remove the power head and try to lift the auger and extension combination by having several people grasp the flighting with their fingers. The latter technique was often ineffective and occasionally resulted in cut hands and fingers. By using the present invention it is possible to snap the extricator handle on an auger and get a good grip on the auger and extension combination so that it can be easily removed from a bored hole. Therefore, it is unnecessary to try to grab the bit by the flighting. It also allows more than one person to help in removal of the auger head and extension combination.

In view of the foregoing, it will be clear to those of ordinary skill in the art that modifications can be made to the structure and function of various different parts of the apparatus without departing from the spirit and scope of the invention.

I claim:

1. An extricating handle for dislodging an earth drill auger of the type having a shaft with a spiral screw-flight therearound, said shaft including a spring-loaded button therein, said handle comprising:

hand grip means;

and auger shaft receiving means for selective connection to said auger shaft, said auger shaft receiving means substantially enclosing one end of said auger shaft when connected thereto, said hand grip means being connectable to said auger shaft receiving means; and, locking means forming part of said auger shaft receiving means for locking said auger shaft with respect to said auger shaft receiving means, said locking means including a first aperture means in said auger shaft receiving means for receiving said spring-loaded button.

2. The handle of claim 1 wherein said shaft receiving means comprises:

an adaptor means including said first aperture means said adaptor means further including a second aperture means therein, said second aperture means including threads therein;

a receptacle box means attached to said hand grip means and including a cavity therein for receiving said adaptor means, said receptacle box means further including a third aperture means substantially coaxial with said second aperture means of said adaptor means when said adaptor means is received in the cavity of said receptacle box means; and, an attaching means for selectively attaching said receptacle box means to said adaptor means.

3. The handle of claim 2 wherein said attaching means comprises a bolt means which passes through said third aperture means and is received in the threads of said second aperture means.

4. The handle of claim 3 wherein said hand grip means comprise a first and a second hand grip arm, each located respectively on opposite sides of said receptacle box means.

5. The handle of claim 4 further comprising a third and a fourth hand grip arm located on opposite sides of said receptacle box means so that said first, second, third and fourth hand grip arms are located approximately at 90° from each other.

6. The handle of claim 4 wherein said first and second hand grip arms are threadedly received in said receptacle box means.

7. The handle of claim 4 further including:

hinge means for attaching said first and second hand grip arms to said receptacle box means.

8. The handle of claim 4 further including:

a wheel attached to the ends of said first and second hand grip arms furtherest removed from said receptacle box means.

9. The handle of claim 1 wherein said handle is a substantially integral and continuous apparatus.

10. An extricating handle for dislodging an earth drill auger of the type having a shaft with a spiral screw-flight therearound, said handle comprising:

handle grip means;

an auger shaft receiving means for selective connection to said auger shaft, said hand grip means being connectable to said auger shaft receiving means; and, locking means for locking said auger shaft with respect to said auger shaft receiving means, said locking means including a spring-biased means for automatically locking said auger shaft to said auger shaft receiving means when said auger shaft receiving means is placed in locking position with respect to said auger shaft.

* * * * *